US011098862B2

(12) United States Patent
DeVol et al.

(10) Patent No.: US 11,098,862 B2
(45) Date of Patent: Aug. 24, 2021

(54) WALL-WASH LIGHTING FIXTURE

(71) Applicant: Hubbell Incorporated, Shelton, CT (US)

(72) Inventors: Nathaniel Stephen Hack DeVol, Greenville, SC (US); David Allen Venhaus, Greenville, SC (US)

(73) Assignee: Hubbell Incorporated, Shelton, CT (US)

( * ) Notice: Subject to any disclaimer, the term of this patent is extended or adjusted under 35 U.S.C. 154(b) by 0 days.

(21) Appl. No.: 16/870,303

(22) Filed: May 8, 2020

(65) Prior Publication Data

US 2020/0355333 A1 Nov. 12, 2020

Related U.S. Application Data

(60) Provisional application No. 62/844,990, filed on May 8, 2019.

(51) Int. Cl.

| | |
|---|---|
| ***F21S 8/02*** | (2006.01) |
| ***F21V 7/00*** | (2006.01) |
| *F21Y 115/10* | (2016.01) |

(52) U.S. Cl.

CPC ..... *F21S 8/024* (2013.01); *F21V 7/0066* (2013.01); *F21Y 2115/10* (2016.08)

(58) Field of Classification Search

None

See application file for complete search history.

(56) References Cited

U.S. PATENT DOCUMENTS

| | | | | |
|---|---|---|---|---|
| 5,800,050 | A | 9/1998 | Leadford | |
| 6,048,084 | A * | 4/2000 | Sedovic | F21S 41/37 362/347 |
| 2012/0044682 | A1 | 2/2012 | Allen et al. | |
| 2013/0120986 | A1 * | 5/2013 | Xi | F21V 5/04 362/235 |
| 2014/0063792 | A1 * | 3/2014 | Spencer | F21V 29/773 362/147 |
| 2014/0063812 | A1 | 3/2014 | Geralds et al. | |
| 2015/0241027 | A1 | 8/2015 | Zhang et al. | |

OTHER PUBLICATIONS

PCT/US2020/032086 International Search Report and Written Opinion dated Aug. 6, 2020 (12 pages).

(Continued)

*Primary Examiner* — Elmito Breval

(74) *Attorney, Agent, or Firm* — Michael Best & Friedrich LLP

(57) ABSTRACT

A wall-wash lighting fixture is provided. The wall-wash lighting fixture includes a solid-state light source having a light emitting surface configured to emit light. The light emitting surface is a long dimension of the light emitting surface. The wall-wash lighting fixture further includes a frustoconical structure. The solid-state light source is positioned to emit light into the frustoconical structure. The wall-wash lighting fixture includes a reflector coupled to the frustoconical structure such that light exiting frustoconical structure is reflected at a non-parallel angle relative to a vertical axis associated with the wall-wash lighting fixture. The reflector defines an opening.

21 Claims, 6 Drawing Sheets

(56) References Cited

OTHER PUBLICATIONS

LiteBox® 4" Remodel Construction RMN4-120 Line Voltage Incandescent Downlight RMN4-120 Spec Sheet, 2 pages.
Architektur 6" Horizontal Triple Open & Wall Wash Downlight CFT632HEB Spec Sheet, 3 pages.
Architektur 6" Vertical Triple Open & Wall Wash Downlight CFT632EB Spec Sheet, 3 pages.
Architektur 8" Horizontal Open & Wall Wash Downlight CFT832HEB Spec Sheet, 2 pages.
Architektur 8" Vertical Open & Wall Wash Downlights CFQ826EB Spec Sheet, 2 pages.

* cited by examiner

WALL-WASH LIGHTING FIXTURE

CROSS-REFERENCE TO RELATED APPLICATIONS

This application claims priority to U.S. Provisional Patent Application No. 62/844,990 filed May 8, 2019, the entire contents of which are incorporated by reference herein.

FIELD

The present disclosure relates generally to wall-wash lighting fixtures.

BACKGROUND

Recessed lighting fixtures can provide light for a space, such as a building or room, and are aesthetically pleasing since the fixtures can be recessed within a ceiling. Wall-wash lighting fixtures, which are a type of recessed lighting fixture, can direct light at an angle to a wall or objects placed along or near the wall. In particular, wall-wash lighting fixtures can include a light source, such as one or more light emitting diodes (LEDs), configured to emit light. In addition, wall-wash lighting fixtures can include a reflector positioned such that light emitted from the light source reflects off the reflector and is directed toward the wall. In this manner, the wall-wash lighting fixture can illuminate the wall.

SUMMARY

Aspects and advantages of embodiments of the present disclosure will be set forth in part in the following description, or may be learned from the description, or may be learned through practice of the embodiments.

In one aspect, a wall-wash lighting fixture is provided. The wall-wash lighting fixture can include a solid-state light source. The solid-state light source can include a light emitting surface configured to emit light. The light emitting surface can have a length dimension that is a long dimension of the light emitting surface. The wall-wash lighting fixture can further include a frustoconical structure. The frustoconical structure can be positioned such that the solid-state light source emits light into the frustoconical structure. The wall-wash lighting fixture can also include a reflector. The reflector can be coupled to the frustoconical structure such that light exiting the frustoconical structure is reflected at a non-parallel angle relative to a vertical direction associated with the wall-wash lighting fixture. Furthermore, the reflector can define an opening.

These and other features, aspects and advantages of various embodiments will become better understood with reference to the following description and appended claims. The accompanying drawings, which are incorporated in and constitute a part of this specification, illustrate embodiments of the present disclosure and, together with the description, serve to explain the related principles.

BRIEF DESCRIPTION OF THE DRAWINGS

Detailed discussion of embodiments directed to one of ordinary skill in the art are set forth in the specification, which makes reference to the appended figures, in which.

DETAILED DESCRIPTION

Figure 1:
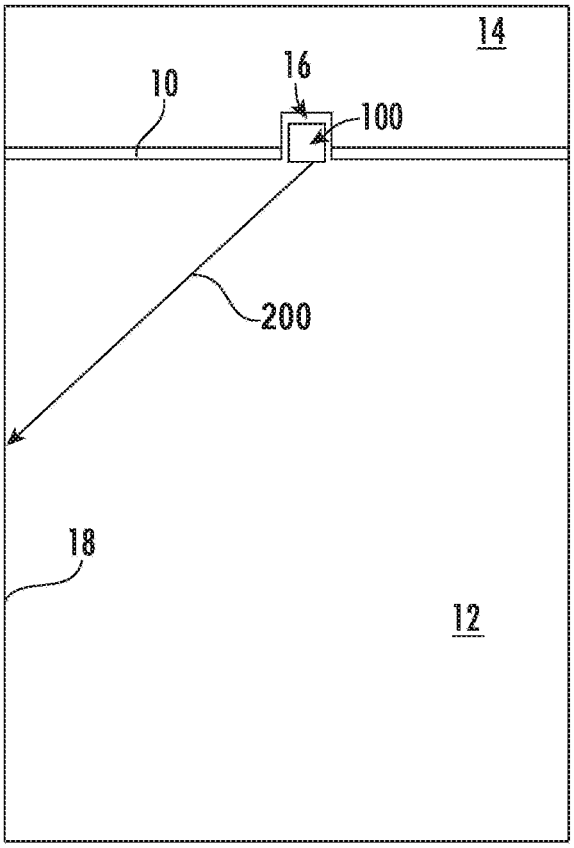
FIG. 1 provides a wall-wash lighting fixture suspended within a ceiling according to example embodiments of the present disclosure.
Figure 2:
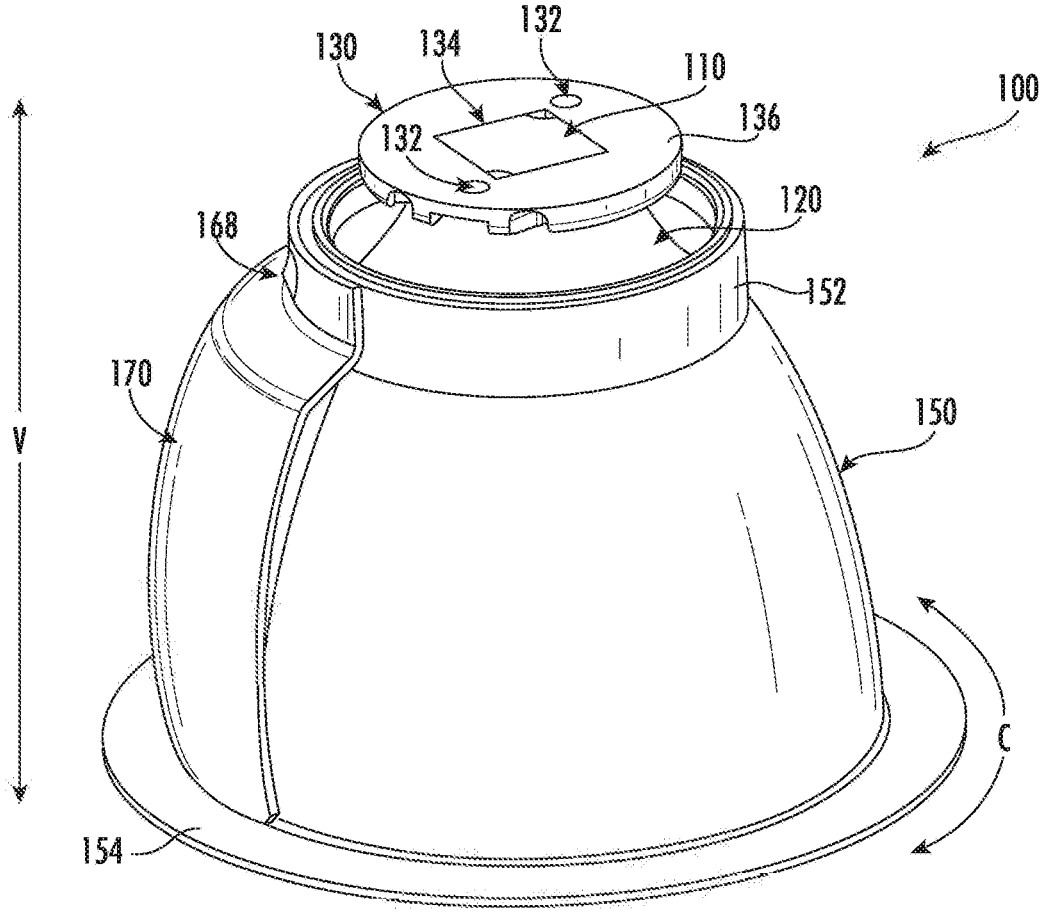
FIG. 2 provides a perspective view of a wall-wash lighting fixture according to example embodiments of the present disclosure.
Figure 3:
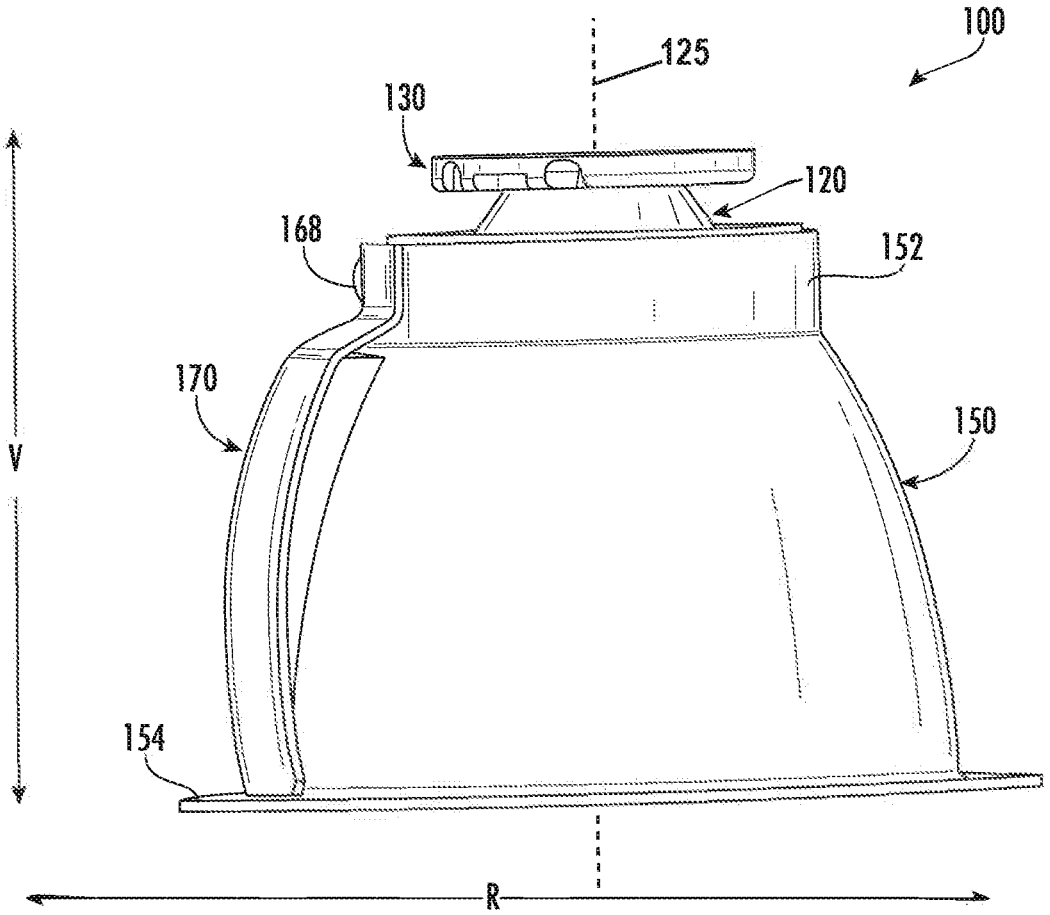
FIG. 3 provides a side view of a wall-wash lighting fixture according to example embodiments of the present disclosure.

Reference now will be made in detail to embodiments, one or more examples of which are illustrated in the drawings. Each example is provided by way of explanation of the embodiments, not limitation of the present disclosure. In fact, it will be apparent to those skilled in the art that various modifications and variations can be made to the embodiments without departing from the scope or spirit of the present disclosure. For instance, features illustrated or described as part of one embodiment can be used with another embodiment to yield a still further embodiment. Thus, it is intended that aspects of the present disclosure cover such modifications and variations.

Example aspects of the present disclosure are directed to a wall-wash lighting fixture. The wall-wash lighting fixture according to the present disclosure can include a solid-state light source. The solid-state light source can include a light emitting surface configured to emit light. The light emitting surface can include a length dimension that is a long dimension measured from a first end of the light emitting surface to a second end of the light emitting surface. In some implementations, a range of the length dimension of the light emitting surface can span from about 0.35 inches to about 0.50 inches.

In some implementations, the wall-wash lighting fixture can include a frustoconical structure. The solid-state light source can be positioned to emit light into the frustoconical structure. In some implementations, the wall-wash lighting fixture can further include a reflector. The reflector can be coupled to the frustoconical structure such that the reflector can receive light exiting the frustoconical structure.

The reflector can include a top portion and a bottom portion. The top portion and the bottom portion can each define an opening. In some implementations, a diameter of the opening defined by the top portion can be smaller than the diameter of the opening defined by the bottom portion. For instance, in some implementations, a range of the diameter of the opening defined by the bottom portion can be from about 2.5 inches to about 3.1 inches.

In some implementations, the diameter of the opening defined by the bottom portion of the reflector can be from about 7.2 to about 9.7 times greater than the length dimension of the light emitting surface. In some implementations, the diameter of the opening defined by the bottom portion of the reflector can be from about 7.6 to 9.4 times greater than the length dimension of the light emitting surface. For example, the diameter of the opening defined by the bottom portion of the reflector be about 7.8 times greater than the length dimension of the light emitting surface.

In some implementations, a height of the wall-wash lighting fixture can be less than about 3.0 inches. In this manner, the height of the wall-wash lighting fixture can be from about 7.2 to about 9.6 times greater than the length dimension of the light emitting surface. Alternatively, the height of the wall-wash lighting fixture can be from about 7.4 to about 9.4 greater than the length dimension of the light emitting surface.

In some implementations, the reflector can include a kicker portion. The reflector and the kicker portion can, in some implementations, be integrally formed as a monolithic component. Alternatively, the kicker portion can be a separate component that can be removably coupled to the reflector. For instance, the reflector and the kicker portion can each define one or more mounting holes. The kicker portion can be positioned relative to the reflector such that the one or more mounting holes defined by the kicker portion align with the one or more mounting holes defined by the reflector. In this manner, the kicker portion can be coupled (e.g., fastened) to the reflector via the fastener (e.g., screw) extending through one of the mounting holes defined by the kicker portion and a corresponding mounting hole defined by the reflector.

When the reflector is coupled to the frustoconical structure, the reflectorcan, as discussed above, receive light exiting the frustoconical structure. In this manner, the light received from the frustoconical structure can reflect off of an interior surface of the reflector. More specifically, the light can reflect off of the interior surface at a non-parallel angle relative to a vertical direction associated with the wall-wash lighting fixture. Furthermore, when the kicker portion is coupled to the reflector, light exiting the frustoconical structure can reflect off of an interior surface of the kicker portion and one or more reflected rays of light can exit the reflector at the non-parallel angle. It should be understood that the one or more reflected rays of light can exit the reflector via the opening defined by the bottom portion of the reflector.

In some implementations, an angular span of the kicker portion defined along an azimuthal or circumferential direction can be greater than about 115 degrees and less than about 230 degrees. For example, the angular span of the kicker portion can be about 120 degrees such that the wall-wash lighting fixture can be used to illuminate a wall of a room. As another example, the angular span of the kicker portion can be about 215 degrees such that the wall-wash lighting fixture can be used to illuminate a corner of a room. In this manner, light reflected off of the interior surface of the kicker portion and exiting the reflector via the opening defined by the bottom portion of the reflector can illuminate two walls of the room that meet with one another to form the corner.

The wall-wash lighting fixture of the present disclosure can provide technical benefits. For instance, an amount of space occupied by the wall-wash lighting fixture can be reduced, because the ratio of the diameter of the opening defined by the reflector to the length dimension of the light emitting surface is improved. In this manner, the wall-wash lighting fixture of the present disclosure can be used in additional applications relative to existing wall wash lighting fixtures. For example, the increased angular span of the kicker portion defined along the azimuthal or circumferential direction allows the wall-wash lighting fixture to be used in corner-wall washing applications.

As used herein, a "wall-wash lighting fixture" refers to a device used to provide light or illumination using one or more light sources. In addition, the terms "first" and "second" may be used interchangeably to distinguish one component from another and are not intended to signify location or importance of the individual components. Furthermore, the use of the term "about" in conjunction with a numerical value is intended to refer to within 2% of the stated numerical value.

FIG. 1 depicts a wall-wash lighting fixture 100 according to example embodiments of the present disclosure. The wall-wash lighting fixture 100 can be removably mounted to a ceiling 10 separating a first space 12 (e.g., positioned beneath the ceiling 10) from a second space 14 (e.g., positioned above the ceiling 10). For instance, the wall-wash lighting fixture 100 can be disposed within an opening or recess 16 defined in the ceiling 10 when the wall-wash lighting fixture 100 is mounted to the ceiling 10. As shown, the wall-wash lighting fixture 100 can emit light 200 to illuminate the first space 12. In some implementations, the light 200 can, as shown, illuminate a wall 18 that defines, at least in part, the first space 12.

Referring now to FIGS. 2 through 5, the wall-wash lighting fixture 100 can define a coordinate system that includes a circumferential direction C, a radial direction R, and a vertical direction V. As shown, the wall-wash lighting fixture 100 can include a solid-state light source 110. The solid-state light source 110 can include a light emitting surface 112 configured to emit light 200. It should be understood that the solid-state light source 110 can include any suitable type of solid-state light source 110. For instance, in some implementations the solid-state light source 110 can include a light emitting diode (LED) device having one or more LED light sources. Furthermore, in such implementations, it should be understood that the LED device can be powered by an LED driver circuit configured to convert an input power to a driver output suitable for driving the one or more LED light sources.

Figure 4:
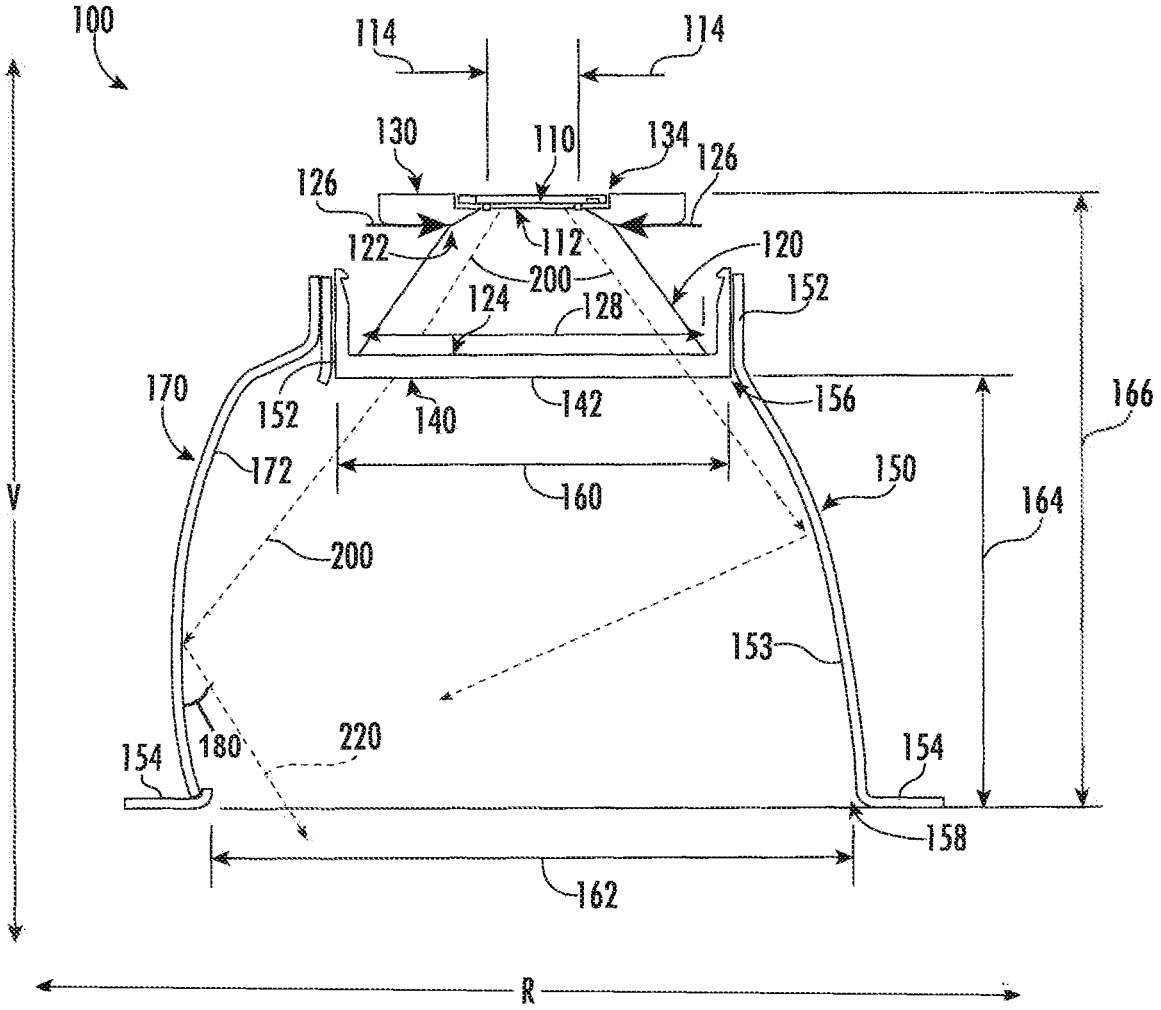
FIG. 4 provides a cross-sectional view of a wall-wash lighting fixture according to example embodiments of the present disclosure.

In some implementations, the wall-wash lighting fixture 100 can include a frustoconical structure 120. As shown in FIG. 4, the frustoconical structure 120 can include a first end 122 and a second end 124. The first end 122 includes an opening having a diameter 126 and the second end 124 includes an opening having a diameter 128. In some implementations, the diameter 126 of the first end 122 can be different than the diameter 128 of the second end 124. For instance, the diameter 128 of the second end 124 can be greater than the diameter 126 of the first end 122. Alternatively, the diameter 128 of the second end 124 can be smaller than the diameter 126 of the first end 122.

In some implementations, the wall-wash lighting fixture 100 can include a first mounting pad 130 and a second mounting pad 140. The first mounting pad 130 and the second mounting pad 140 can each be integrally formed with the frustoconical structure 120 in some implementations. For instance, the first mounting pad 130 can be integrally formed with the frustoconical structure 120 at the first end 122 thereof. Alternatively, or additionally, the second mounting pad 140 can be integrally formed with the frustoconical structure 120 at the second end 124 thereof.

In alternative implementations, at least one of the first mounting pad 130 and the second mounting pad 140 can be separate from frustoconical structure 120. In such implementations, the first mounting pad 130, the second mounting pad 140, or both can be coupled to the frustoconical structure 120. For example, the first mounting pad 130 can be coupled to the first end 122 of the frustoconical structure 120. Alternatively or additionally, the second mounting pad 140 can be coupled to the second end 124 of the frustoconical structure 120. It should be understood that the first mounting pad 130 and the second mounting pad 140 can be coupled to the frustoconical structure 120 in any suitable manner.

In some implementations, the first mounting pad 130 can define one or more mounting holes 132. In this manner, the wall-washing lighting fixture 100 can be secured to a mounting surface (e.g., ceiling 10 of FIG. 1) via one or more fasteners (not shown) extending through the one or more mounting holes 132. Alternatively, and/or additionally, the first mounting pad 130 can define an opening 134 configured to accommodate the solid-state light source 110.

The solid-state light source 110 of the wall-wash lighting fixture 100 can be positioned to emit light 200 into the frustoconical structure 120. In some implementations, the solid-state light source 110 can be positioned within the opening 134 defined by the first mounting pad 130. In this manner, the light 200 emitted from the light emitting surface 112 can enter the frustoconical structure 120 via the first end 122 thereof. It should be understood, however, that the solid-state light source 110 can be positioned to emit light 200 into the frustoconical structure 120 from any suitable location.

As shown, the wall-wash lighting fixture 100 can include a reflector 150. The reflector 150 can include a top portion 152 and a bottom portion 154. As shown, the top portion 152 of the reflector 150 and the bottom portion 154 of the reflector 150 can each define an opening 156, 158, respectively. The opening 156 defined by the top portion 152 can be configured to accommodate the frustoconical structure 120. More specifically, the opening 156 can be configured to accommodate the second mounting pad 140 that, as discussed above, can be integrally formed with the frustoconical structure 120 or separate therefrom. In the illustrated embodiment, the reflector 150 defines a central axis 125 extending in the vertical direction V. More specifically, the central axis 125 extends through the center of the opening 156 in the top portion 152 and the center of the opening 158 in the bottom portion 154.

In some implementations, a diameter 160 of the opening 156 defined by the top portion 152 can be different than a diameter 162 of the opening 158 defined by the bottom portion 154. For instance, the diameter 160 of the opening 156 defined by the top portion 152 can be smaller than the diameter 162 of the opening 158 defined by the bottom portion 154.

In some implementations, the diameter 162 of the opening 158 defined by the bottom portion 154 of the reflector 150 can be greater than a diameter of the opening 16 (FIG. 1) in which the wall-wash lighting fixture 100 is disposed when mounted to the ceiling 10 (FIG. 1). In this manner, the opening 16 can be hidden from view when the wall-wash lighting fixture 100 is mounted to the ceiling 10. Additionally, when mounted to the ceiling 10, the wall-wash lighting fixture 100 can be further concealed by coupling a baffle (not shown) either directly to the wall-wash lighting fixture 100 or to the ceiling 10 adjacent the wall-wash lighting fixture. The baffle can be various sizes and shapes to accommodate the wall-wash lighting fixture 100.

In some implementations, the diameter 162 of the opening 158 defined by the bottom portion 154 can be less than about 3.5 inches. More specifically, a range of the diameter 162 of the opening 158 defined by the bottom portion 154 can be from about 2.5 inches to about 3.1 inches. In some implementations, the diameter 162 of the opening 158 defined by the bottom portion 154 can be less than about 3 inches.

In some implementations, the diameter 162 of the opening 158 defined by the bottom portion 154 of the reflector 150 can be between about 7.2 and about 9.7 times greater than a length dimension 114 of the light emitting surface 112. In some implementations, the diameter 162 of the opening 158 can be between about 7.6 and 9.4 times greater than the length dimension 114 of the light emitting surface 112. For example, the diameter 162 of the opening 158 may be 7.8 time greater than the length dimension 114 of the light emitting surface 112.

In some implementations, the reflector 150 can be coupled to the frustoconical structure 120. For example, the reflector 150 can be coupled to the frustoconical structure 120 via the second mounting pad 140. More specifically, the second mounting pad 140 and the top portion 152 of the reflector 150 can each define one or more mounting holes (not shown). The reflector 150 can be positioned relative to the second mounting pad 140 such that the one or more mounting holes defined by the top portion 152 of the reflector 150 align with the one or more mounting holes defined by the second mounting pad 140. In this manner, the reflector 150 can be secured (e.g., fastened) to the second mounting pad 140 via a fastener 168 (e.g., screw) extending through one of the mounting holes defined by the top portion 152 of the reflector 150 and a corresponding mounting hole defined by the second mounting pad 140.

It should be understood, however, that the reflector 150 can be coupled to frustoconical structure 120 via the second mounting pad 140 using any suitable type of fastener. It should also be understood that, in some implementations, the reflector 150 can be integrally formed with the frustoconical structure 120. In such implementations, the wall-wash lighting fixture 100 may not include the second mounting pad 140 that, as discussed above, can be used to couple the reflector 150 to the frustoconical structure 120.

In some implementations, a distance 164 measured along the vertical direction V from the bottom portion 154 of the reflector 150 to the bottom 142 of the second mounting tab 140 can be about 1.9 inches. Furthermore, in some implementations, the distance 164 from the bottom portion 154 of the reflector to the bottom 142 of the second mounting tab 140 can be from about 4.9 to about 6.5 times greater than the length dimension 114 of the light emitting surface. In some implementations, the distance 164 can be from about 5.1 to about 6 time greater than length dimension 114. For example, the distance 164 can be about 5.2 greater than the length dimension 114.

In some implementations, a height 166 of the wall-wash lighting fixture 100 can be less than about 3.0 inches. It should be understood that the height 166 of the wall-wash lighting fixture 100 can be measured along the vertical direction V from the bottom portion 154 of the reflector 150 to the top 136 of the first mounting pad 130. In some implementations, the height 166 of the wall-wash lighting fixture 100 can be from about 7.2 to about 9.6 times greater than the length dimension 114 of the light emitting surface 112. In some implementations, the height 166 can be from about 7.4 to about 9.4 times greater than the length dimension 114. For instance, the height 166 of the wall-wash lighting fixture 100 can be about 7.5 times greater than the length dimension 114 of the light emitting surface 112.

In some implementations, the reflector 150 can include a kicker portion 170. The reflector 150 and the kicker portion 170 can, in some implementations, be integrally formed as a monolithic component. Alternatively, the kicker portion 170 can be a separate component that can be removably coupled to the reflector 150. For instance, the reflector 150 and the kicker portion 170 can each define one or more mounting holes (not shown). The kicker portion 170 can be positioned relative to the reflector 150 such that the one or more mounting holes defined by the kicker portion 170 align with the one or more mounting holes defined by the reflector 150. In this manner, the kicker portion 170 can be secured (e.g., fastened) to the reflector 150 via the fastener 168 (e.g., screw) extending through one of the mounting holes defined by the kicker portion 170 and a corresponding mounting hole defined by the reflector 150. It should be understood, however, that the kicker portion 170 can be coupled to the reflector 150 in any suitable manner.

When the reflector 150 is coupled to the frustoconical structure 120, the reflector 150 can receive light 200 exiting the frustoconical structure 120. As shown, the light 200 received from the frustoconical structure 120 can reflect off of an interior surface 153 of the reflector 150. More specifically, the light 200 can reflect off of the interior surface 153 at a non-parallel angle 180 relative to the vertical direction V. Furthermore, when the kicker portion 170 is coupled to the reflector 150, the light 200 exiting the frustoconical structure 120 can, as shown in FIG. 4, reflect off an interior surface 172 of the kicker portion 170 and one or more reflected rays of light 220 can exit the reflector 150 at the non-parallel angle 180 relative to the vertical direction V. More specifically, the one or more reflected rays of light 220 can exit the reflector 150 via the opening 158 defined by the bottom portion 154 of the reflector 150.

Figure 5:
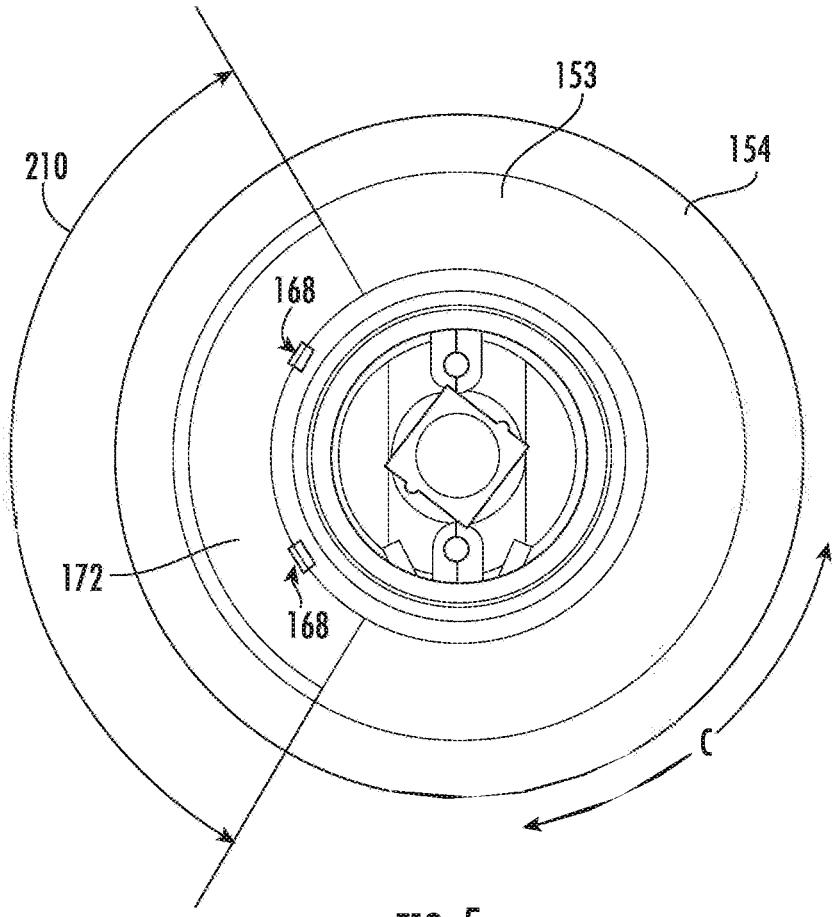
FIG. 5 provides a bottom-view of a wall-wash lighting fixture according to example embodiments of the present disclosure.

Referring now to FIG. 5, in some implementations an angular span 210 of the kicker portion 170 defined along an azimuthal or circumferential direction C associated with the wall-wash lighting fixture 100 can be greater than about 115 degrees and less than about 230 degrees. For example, in some implementations the angular span 210 of the kicker portion 170 defined along the circumferential direction C can be about 120 degrees such that the wall-wash lighting fixture 100 can be used to illuminate a wall 18 of a room 12. In alternative implementations, the angular span of the kicker portion 170 can be about 215 degrees such that the wall-wash lighting fixture 100 can be used to illuminate a corner of the room 12. In this manner, light 200 reflected off of the interior surface 172 of the kicker portion 170 and exiting the reflector 150 as the one or more reflected rays of light 220 can illuminate two walls 18 of the room 12 that meet one another to form the corner.

Figure 6:
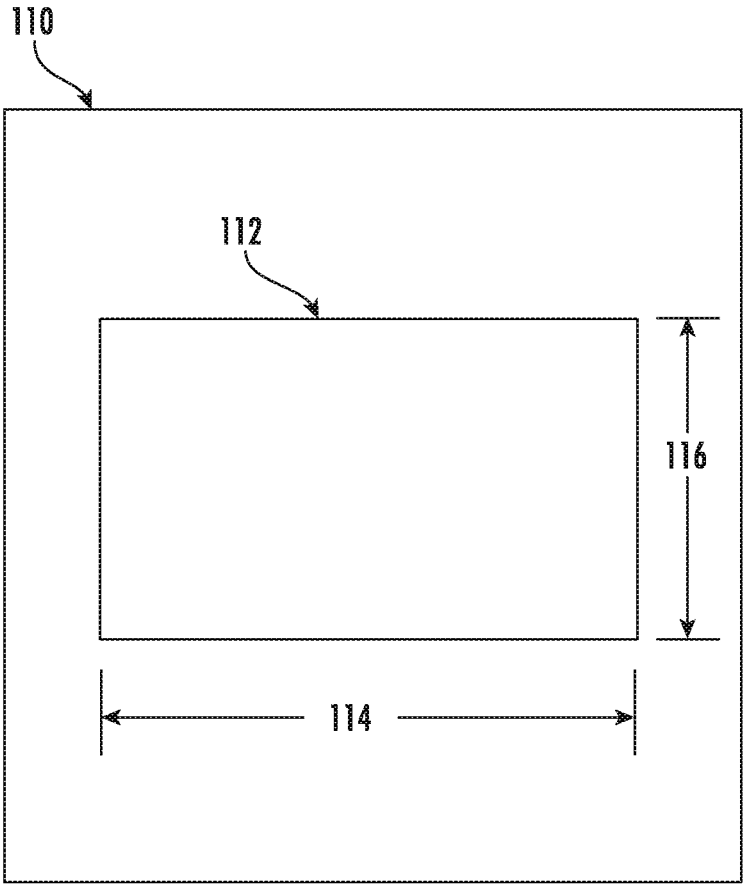
FIG. 6 provides a solid-state light source of a wall-wash lighting fixture according to example embodiments.

Referring now to FIG. 6, an example embodiment of the solid-state light source is provided according to present disclosure. As shown, the length dimension 114 of the light emitting surface 112 can be a long dimension of the light emitting surface 112. More specifically, the length dimension 114 can be longer than a width dimension 116 of the light emitting surface 112. In some implementations, a range of the length dimension 114 of the light emitting surface 112 can span from about 0.35 inches to about 0.50 inches.

Although the light emitting surface 112 of FIG. 6 is depicted as having a rectangular shape, it should be understood that the light emitting surface 112 can have any suitable shape. For instance, in some implementations the light emitting surface can have an annular shape. Furthermore, in such implementations, it should be understood that the length dimension 114 can correspond to a diameter of the light emitting surface 112.

While the present subject matter has been described in detail with respect to specific exemplary embodiments thereof, it will be appreciated that those skilled in the art, upon attaining an understanding of the foregoing, may readily produce alterations to, variations of, and equivalents to such embodiments. Accordingly, the scope of the present disclosure is by way of example rather than by way of limitation, and the subject disclosure does not preclude inclusion of such modifications, variations and/or additions to the present subject matter as would be readily apparent to one of ordinary skill in the art.

What is claimed is:

1. A wall-wash lighting fixture, comprising:

a solid state light source having a light emitting surface configured to emit light, the light emitting surface having a length dimension;

a frustoconical structure positioned adjacent the solid state light source such that the light emitting surface emits light into the frustoconical structure; and a reflector defining an opening and a central axis extending through the opening, the reflector coupled to the frustoconical structure and arranged relative to the frustoconical structure such that light exiting the frustoconical structure is reflected by the reflector at a non-parallel angle relative to the central axis of the reflector, wherein a diameter of the opening defined by the reflector is between about 7.2 and 9.7 times greater than the length dimension of the light emitting surface.

2. The wall-wash lighting fixture of claim 1, wherein the diameter of the opening defined by the reflector is between 7.6 and 9.4 times greater than the length dimension of the light emitting surface.

3. The wall-wash lighting fixture of claim 1, wherein the reflector includes a kicker portion, and wherein an angular span of the kicker portion defined along an azimuthal direction is greater than 115 degrees.

4. The wall-wash lighting fixture of claim 1, wherein the reflector includes a kicker portion, and wherein an angular span of the kicker portion defined along an azimuthal direction is greater than 120 degrees and less than 230 degrees.

5. The wall-wash lighting fixture of claim 1, wherein the diameter of the opening defined by the reflector is less than 3.5 inches.

6. The wall-wash lighting fixture of claim 1, wherein the diameter of the opening defined by the reflector is between 2.5 inches and 3.1 inches.

7. The wall-wash lighting fixture of claim 1, wherein the diameter of the opening defined by the reflector is less than 3 inches.

8. The wall-wash lighting fixture of claim 1, wherein a height of the wall-wash lighting fixture is between 7.2 and 9.6 times greater than the length dimension of the light emitting surface.

9. The wall-wash lighting fixture of claim 1, wherein a height of the wall-wash lighting fixture is between 7.4 and 9.4 times greater than the length dimension of the light emitting surface.

10. The wall-wash lighting fixture of claim 1, wherein a height of the wall-wash lighting fixture is less than about 3.0 inches.

11. The wall-wash lighting fixture of claim 1, wherein the solid state light source comprises a light emitting diode (LED) light source.

12. A wall-wash lighting fixture, comprising:

a solid state light source having a light emitting surface configured to emit light;

a frustoconical structure positioned to receive light emitted from the solid state light source; and a reflector defining an opening and a central axis extending through the opening, the reflector coupled to the frustoconical structure and including a kicker portion, the reflector arranged to receive light exiting the frustoconical structure and reflect the light at a non-parallel angle relative to the central axis of the reflector, wherein an angular span of the kicker portion defined along an azimuthal direction is greater than about 115 degrees.

13. The wall-wash lighting fixture of claim 12, wherein the angular span of the kicker portion is greater than about 120 degrees and less than about 230 degrees.

14. The wall-wash lighting fixture of claim 12, wherein the reflector defines an opening having a diameter, and wherein the diameter of the opening is between 7.2 and 9.7 times greater than a length dimension of the light emitting surface.

15. The wall-wash lighting fixture of claim 12, wherein the reflector defines an opening having a diameter, and wherein the diameter of the opening is between 7.6 and 9.4 times greater than a length dimension of the light emitting surface.

16. The wall-wash lighting fixture of claim 12, wherein a height of the wall-washing fixture is between 7.2 and 9.6 times greater than a length dimension of the light emitting surface.

17. The wall-wash lighting fixture of claim 12, wherein a height of the wall-washing lighting fixture is between 7.4 and 9.4 times greater than a length dimension of the light emitting surface.

18. The wall-wash lighting fixture of claim 12, wherein the reflector includes an opening having a diameter, and wherein the diameter of the opening is less than about 3.5 inches.

19. The wall-wash lighting fixture of claim 12, wherein the reflector includes an opening having a diameter, and wherein the diameter of the opening is between 2.5 inches to 3.1 inches.

20. The wall-wash lighting fixture of claim 12, wherein the reflector includes an opening having a diameter, and wherein the diameter of the opening is less than about 3 inches.

21. The wall-wash lighting fixture of claim 12, wherein the solid state light source comprises a light emitting diode (LED) light source.

* * * * *